United States Patent [19]

Bainard

[11] 4,082,295

[45] Apr. 4, 1978

[54] REED VALVE WITH CRANKSHAFT SEAL AND METHOD

[75] Inventor: Dean R. Bainard, Bethel Township, County of York, S.C.

[73] Assignee: Garlock Inc., Rochester, N.Y.

[21] Appl. No.: 800,196

[22] Filed: May 25, 1977

[51] Int. Cl.[2] ..... F02B 75/20

[52] U.S. Cl. ..... 277/1; 123/59 B; 123/73 V; 137/856

[58] Field of Search ..... 277/1, 237 R; 251/119; 137/855, 856; 123/73 V, 59 B

[56] References Cited

U.S. PATENT DOCUMENTS

| | | | |
|---|---|---|---|
| 2,630,791 | 3/1953 | Kiekhaefer | 123/59 B |
| 2,669,979 | 2/1954 | Kiekhaefer | 123/73 V |
| 2,689,552 | 9/1954 | Kiekhaefer | 251/119 |
| 3,115,155 | 12/1963 | Clark | 137/855 |
| 3,286,728 | 11/1966 | Stephenson | 137/856 |

*Primary Examiner*—Robert I. Smith
*Attorney, Agent, or Firm*—Schovee & Boston

[57] ABSTRACT

The improvement in a reed valve for use between crankcase chambers of a two-stroke engine, comprising a flat, ring-shaped steel insert having a rubber coating on one side thereof and including a sealing lip on the I.D. thereof. One insert is secured on each side of a reed block between the block and the reeds with the rubber facing the reeds to cushion the contact between the reeds and the block, and the sealing lip provides a positive-contact seal against the crankshaft.

17 Claims, 2 Drawing Figures

REED VALVE WITH CRANKSHAFT SEAL AND METHOD

BACKGROUND OF THE INVENTION

1. Field of the Invention

This invention relates to reed valves and in particular to a reed valve including an integral shaft sealing lip for use between the crankcase chambers of a multi-cylinder, two stroke engine.

2. Description of the Prior Art

A sealing problem exists between crankcase chambers of multi-cylinder two stroke engines. This is especially true when the engine uses a circular reed valve assembly between the crankcase chambers. Current practices use a labyrinth seal or split rings of polytetrafluoroethylene. Neither of these, however, is satisfactory and leakage between the crankcase chamber causes rough idling and inefficient performance.

It is an object of the present invention to overcome these problems of the prior art and to provide a reed valve assembly with an integral positive-contact shaft seal. It is another object of the invention to provide a rubber facing for the reed block for increasing engine performance throughout the rpm range.

SUMMARY OF THE INVENTION

In a circular reed valve assembly for use betwen crankcase chambers of multi-cylinder two-stroke engines including a reed block made of complementary semi-cylindrical sections assembled over a crankshaft and having an air passage and exit ports and including thin spring steel reeds secured at one end to the reed block for opening and closing the ports, the improvement comprising a flat metal insert, having a layer of elastomer bonded to the outer surface thereof, secured on each side of the reed block between the block and the reeds and having congruent openings overlying each reed block port. The layer of elastomer faces the reed and cushions the contact between the reed and the reed block. The layer of elastomer also includes an annular, positive-contact, shaft sealing lip for sealing against the crankshaft.

BRIEF DESCRIPTION OF THE DRAWING

The present invention will be more fully understood by reference to the following detailed description thereof, when read in conjunction with the attached drawing, wherein like reference numerals refer to like elements and wherein.

DETAILED DESCRIPTION OF THE PREFERRED EMBODIMENT

Figure 1:
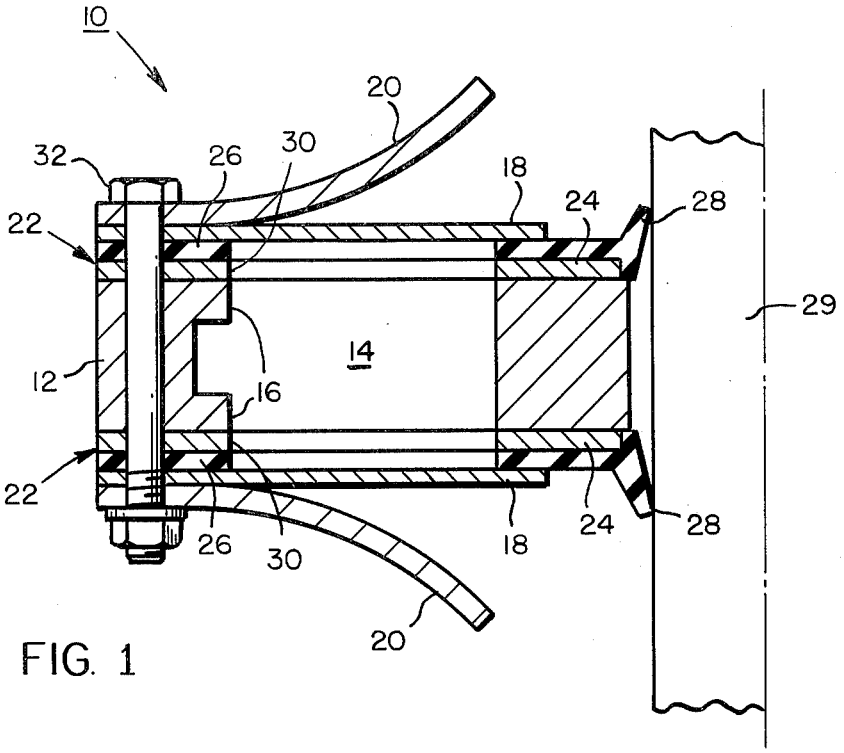
FIG. 1 is a partial cross-sectional view through the reed valve and shaft seal according to the preferred embodiment of the present invention.

Referring now to the drawing, FIG. 1 shows a reed valve 10 according to the present invention for use, for example, between crankcase chambers in a multi-cylinder two-stroke engine. Reed valves for such use are well-known in the art as described, for example, in U.S. Pat. No. 2,689,552, the disclosure of which is incorporated herein by reference, and it is noted that the improvement of the insert of the present invention can be used on the reed block 14 of that patent U.S. Pat. No. 2,689,552.

The reed valve 10 includes a reed block 12 having a gas passage 14 therein and a plurality (usually four) of ports 16 on each side of the reed block. Secured to the reed block 12 on each side thereof and over each port 16 is an individual thin spring steel petal or reed 18 secured at one end only of the reed for opening and closing a respective port 16. Secured to the reed block 12 over the reed 18 is a stop 20 to limit the extent of travel of the reed 18 when the reed moves to its port-open position from its port-closed position. According to the present invention, an insert 22 is secured to each side of the reed block 12 between the reed block and the reeds 18. The insert 22 includes a flat metal ring 24 and a layer 26 of elastomer bonded to one surface thereof and including a sealing lip 28 tapering radially inwardly and axially outwardly from the I.D. of the metal ring 24 and in sealing contact with the crankshaft 29. Each of the metal inserts 22 includes a plurality of openings 30 corresponding to and overlying the ports 16. The reeds, inserts, and stops are secured to the reed block by means of a bolt and nut 32.

Figure 2:
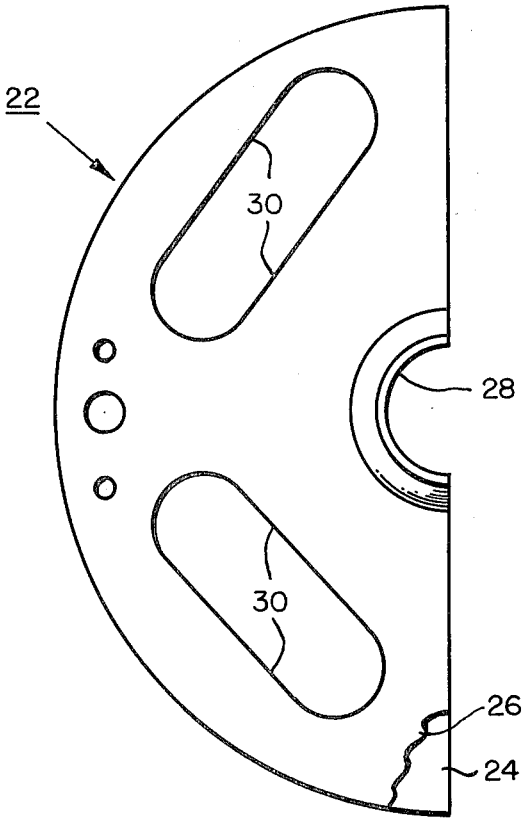
FIG. 2 is a plan view of the insert of the present invention.

As shown in FIG. 2, the insert 22 is made in two semi-circular halves for attachment around the crankshaft 29. Similarly, as is known in the art, the reed block 12 is also made in two semi-cylindrical parts which are then held together in the application.

The metal (preferably steel) insert 22 of the present invention can also be used without the sealing lip 28 thereof and can be used in other than annular reed valve configurations. For example, the insert can be used with a reed block having an inverted "V" configuration as shown in U.S. Pat. No. 3,286,728 in which application the insert can, for example, be formed flat and then be folded over to result in an inverted "V" shape to fit over the reed plate 15 of said patent, or the insert can be two separate elements. The insert can also be used with a reed block having ports on only one side thereof, such as the upper half of the embodiment of FIG. 1 of this application. This method of providing a resilient layer between the reed block and the reed will result in a cost savings over the prior art of providing a recess in the reed block to receive a resilient layer (see U.S. Pat. No. 3,286,728). Other shapes and types of sealing lips can be used in place of the sealing lip 28, if desired, as will be understood by those skilled in the art. Further, the layer 26 of elastomer need not cover the entire metal ring 24, and the elastomer around the ports that accomplishes the cushioning, to prevent chipping of the reeds, for example, can be different or the same as the elastomer of the sealing lip 28. Regarding the reeds, there can be a single reed for each port or one reed for a plurality of ports.

The invention has been described in detail with particular reference to the preferred embodiments thereof, but it will be understood that variations and modifications can be effected within the spirit and scope of the invention as described hereinabove and as defined in the appended claims.

I claim:

1. A reed valve comprising:

(a) a reed block having a gas passage therein and an exit port for said passage, (b) a reed secured at one end thereof to said block and adapted to cover said port and being movable between port-closed and port-open positions in response to gas pressures on opposite sides of said reed, (c) a stop secured to said block and positioned spaced-away from said port a predetermined distance for limiting the extent of movement of said reed when in said port-open position, and (d) a metal insert including a layer of elastomer bonded thereto and being secured to said reed block between said reed block and said reed, said insert having an opening therein substantially identical to and overlying said port, and said layer of elastomer being on the outside surface of said insert facing said reed, for cushioning the contact between said reed block and said reed.

2. A reed valve according to claim 1 wherein said reed valve is for use between two adjacent crankcase chambers of a multi-cylinder, two-stroke engine and is adapted to be positioned around a crankshaft, wherein said reed block and insert are ring-shaped and have a central opening to accommodate a crankshaft, and wherein said layer of elastomer includes an annular shaft sealing lip adjacent the I.D. of said insert for sealing against a crankshaft.

3. A reed valve according to claim 2 wherein said reed block includes a plurality of ports on each side thereof and including a plurality of reeds for covering said plurality of ports, wherein said metal insert includes a plurality of corresponding openings, and including one of said metal inserts being secured to said block on each side thereof.

4. The reed valve according to claim 3 wherein the sealing lip on each of said inserts tapers radially inwardly and axially outwardly away from said reed block.

5. The reed valve according to claim 4 wherein said layer of elastomer completely covers said outside surface of said insert.

6. The reed valve according to claim 5 wherein each of said inserts includes a flat steel ring to which said layer of elastomer is bonded.

7. The reed valve according to claim 1 wherein said reed block includes a plurality of ports on each side thereof and including a plurality of reeds for covering said plurality of ports, wherein said metal insert includes a plurality of corresponding openings, and including a metal insert secured to said block on each side thereof.

8. The reed valve according to claim 1 wherein said layer of elastomer completely covers said outside surface of said insert.

9. The reed valve according to claim 8 wherein said insert includes a flat steel ring to which said layer of elastomer is bonded.

10. A reed valve for use between two adjacent crankcase chambers of a multi-cylinder, two-stroke engine and adapted to be positioned around a crankshaft comprising:

(a) a ring-shaped reed block having a gas passage therein and an exit port for said passage and a central opening for accommodating a crankshaft, (b) a reed secured at one end thereof to said block and adapted to cover said port and being movable between port-closed and port-open positions in response to gas pressures on opposite sides of said reed, (c) a stop secured to said block and positioned spaced-away from said port a predetermined distance for limiting the extent of movement of said reed when in said port-open position, and (d) a ring-shaped metal insert having a central opening to accommodate a crankshaft and including an annular, elastomeric shaft sealing lip bonded to said insert adjacent the I.D. thereof for sealing against a crankshaft, said insert being secured to said reed block between said reed block and said reed and having an opening therein substantially identical to and overlying said port.

11. A reed valve according to claim 10 wherein said reed block includes a plurality of ports on each side thereof and including a plurality of reeds for covering said plurality of ports, wherein said metal insert includes a plurality of corresponding openings, and including one of said metal inserts being secured to said block on each side thereof.

12. The reed valve according to claim 10 wherein said sealing lip tapers radially inwardly and axially outwardly away from said reed block.

13. The reed valve according to claim 10 wherein said insert includes a flat steel ring to which said elastomeric shaft sealing lip is bonded.

14. A method for sealing adjacent crankcase chambers of a multi-cylinder two-stroke engine comprising: providing a reed valve, including a reed block with ports controlled by reeds, between said chambers and around a crankshaft and sealing the crankshaft passing through said reed block by securing a metal insert, having an elastomeric shaft sealing lip bonded to the I.D. thereof, to said reed block between said block and reeds, and positioning said sealing lip in sealing contact with the crank-shaft.

15. The method according to claim 14 including the step of cushioning the contact between the reed block and the reeds by providing a layer of elastomer bonded to the outside surface of said insert.

16. The method according to claim 15 including forming said insert with an O.D. and an I.D. substantially identical to that of said reed block and with openings therein substantially identical to and overlying said ports.

17. The method according to claim 16 including forming said layer of elastomer and said sealing lip as one integral body.

* * * * *